United States Patent [19]

Nozawa et al.

[11] Patent Number: 4,530,449

[45] Date of Patent: Jul. 23, 1985

[54] LIQUID SPRAYING DEVICE

[75] Inventors: Takamitsu Nozawa, Tokyo; Takao Kishi, Funabashi; Shigeo Iizuka, Tokyo, all of Japan

[73] Assignee: Yoshino Kogyosho Co. Ltd., Tokyo, Japan

[21] Appl. No.: 118,739

[22] Filed: Feb. 5, 1980

[30] Foreign Application Priority Data

Mar. 19, 1979 [JP] Japan ..... 54-32061

[51] Int. Cl.[3] ..... B05B 9/043

[52] U.S. Cl. ..... 222/189; 222/383; 239/333

[58] Field of Search ..... 222/630, 631, 634, 383, 222/384, 385, 189; 239/331, 333

[56] References Cited

U.S. PATENT DOCUMENTS

| | | | |
|---|---|---|---|
| 3,756,472 | 9/1973 | Vos | 222/189 |
| 3,774,849 | 11/1973 | Boris | 222/385 X |
| 4,017,031 | 4/1977 | Kishi et al. | 222/385 X |
| 4,050,613 | 9/1977 | Corsette | 222/383 X |

*Primary Examiner*—F. J. Bartuska

*Attorney, Agent, or Firm*—Parkhurst & Oliff

[57] ABSTRACT

A miniature type, rechargeable atomizing spray mechanism having a container for the liquid to be atomized, and further having a cap and axially aligned first and second pressure chambers, one of which depends within a receptacle while the other projects above the cap. A reciprocable spray head or actuator is arranged to cooperate with plural pistons, one each of which are telescopically arranged in said first and second pressure chambers. Upper and lower valve members are available to control the emission of spray of the liquid. The upper valve is maintained closed by a spring element, and the lower valve is opened by reciprocation of the actuator to permit withdrawal of the liquid from the container so that it may pass through a bore provided between the plural pistons and in the pressure chambers and be emitted as a spray from the spray nozzle at the spray head. Said first pressure chamber has advantageously at least one elevational rib axially formed within an annular recess formed on the inside peripheral wall thereof for providing a gap between the piston and the first pressure chamber means to thereby smoothly pump the liquid in the liquid container to the nozzle through the pistons telescoped within the respective pressure chambers and liquid passage in the actuator.

2 Claims, 5 Drawing Figures

LIQUID SPRAYING DEVICE

BACKGROUND OF THE INVENTION

The present invention relates to an atomizer and, more particularly, to a liquid atomizer of manual type for atomizing a liquid such as perfume, cosmetic preparations or the like.

The conventional liquid atomizer incorporates a first cylinder downwardly suspended from the center of a cap located on the neck portion of a container, a second cylinder of larger diameter than that of the first cylinder coaxially disposed with the first cylinder within a head or an actuator elevationally movably disposed at the upper portion of the cap, one tubular slide disposed between the first and the second cylinders and including a lower piston telescopically inserted into the first cylinder and an upper piston telescopically inserted into the second cylinder, a valve formed at the top of the slide, and a coil spring so mounted as to maintain the valve at a position for shutting off the communication between the first cylinder and a spraying nozzle.

When the actuator of the atomizer thus construced is depressed down to slide the tubular slide, it pressurizes the liquids contained within both the first and the second cylinders to thereby permit the second piston to be liable to relatively move with respect to the first piston against the tension of the coil spring acting on the second piston. When the liquid pressure sufficiently balances with the tension of the coil spring, the second piston telescopically moves to thereby open the valve connected thereto. Thus, the interiors of both the first and the second cylinders communicate with the nozzle to thereby spray the liquid through the nozzle. Accordingly, the liquid is not sprayed from the nozzle until the liquid pressure reaches a predetermined value within both the first and the second cylinders to thereby avoid the dropping of liquid droplets without atomization from the nozzle. This dropping phenomenon of liquid droplets occurs when both the first and the second cylinders communicate with the nozzle from the beginning upon telescopic movements of the first piston. This dropping phenomenon also takes place similarly upon completion of the telescopic movement of the first piston in the first cylinder. When the liquid pressure has a weaker strength than the returning strength or tension of the coil spring of the second piston into the second cylinder, to the second piston, the valve is closed by the coil spring to thereby shut off the communication between both the first and the second cylinders and the valve.

The conventional atomizer of this type has such a disadvantage that, since the liquid pressure is increased higher as the tubular slide or hollow piston is depressed at longer stroke, it is difficult to initially spray the high pressure liquid. This atomizer also has another disadvantage that, when the piston is telescopically moved to its extending limit in the cylinder in order to exactly introduce the liquid into a pressure chamber by slight priming operation by the initial depression of the tubular alide, the air contained within the pressure chamber is exhausted not only into the liquid container but into the atmosphere to thereby induce the dropping of liquid droplets through the nozzle.

On the other hand, the conventional atomizer can suffer blockage of its nozzle hole, which is smaller in diameter than the gap passage of liquid, when solid insolubles are mixed within the liquid. This thereby causes damage to the atomizer.

SUMMARY OF THE INVENTION

It is, therefore, one primary object of the present invention to provide a manual type liquid miniature atomizer which can eliminate the aforementioned drawbacks and disadvantages of the conventional atomizer of manual type.

Another important object of the present invention is to provide a manually operated miniature atomizer of improved type which can be operated reliably and efficiently even from the initial use.

A futher object of the present invention is to provide an improved manual type miniature atomizer, into which elements having a return coil spring can be assembled simply and conveniently.

Yet another object of the present invention is to provide an improved manual type miniature atomizer which is featured by such a construction as can easily accomplish replacement in a pumping or priming or pressure chamber between air and a working liquid even for its initial use without any accompanying leakage of the liquid to the outside into the atmosphere by completely preventing excessive vacuum in its container.

Still another object of the present invention is to provide an improved manual type miniature atomizer which can exactly prevent the closure of its nozzle hole due to solid insolubles contained within the liquid and contents with a mesh filter capable of stopping passage of the solid insolubles to thereby always provide smooth liquid atomization even after the quantity of the liquid therein is reduced substantially through a number of depressing operations.

The foregoing objects and other objects as well as the characteristic features of the invention will become more apparent and more readily understandable by the following description and the appended claims when read in conjunction with the accompanying drawings.

DESCRIPTION OF THE PREFERRED EMBODIMENTS

Figure 1:
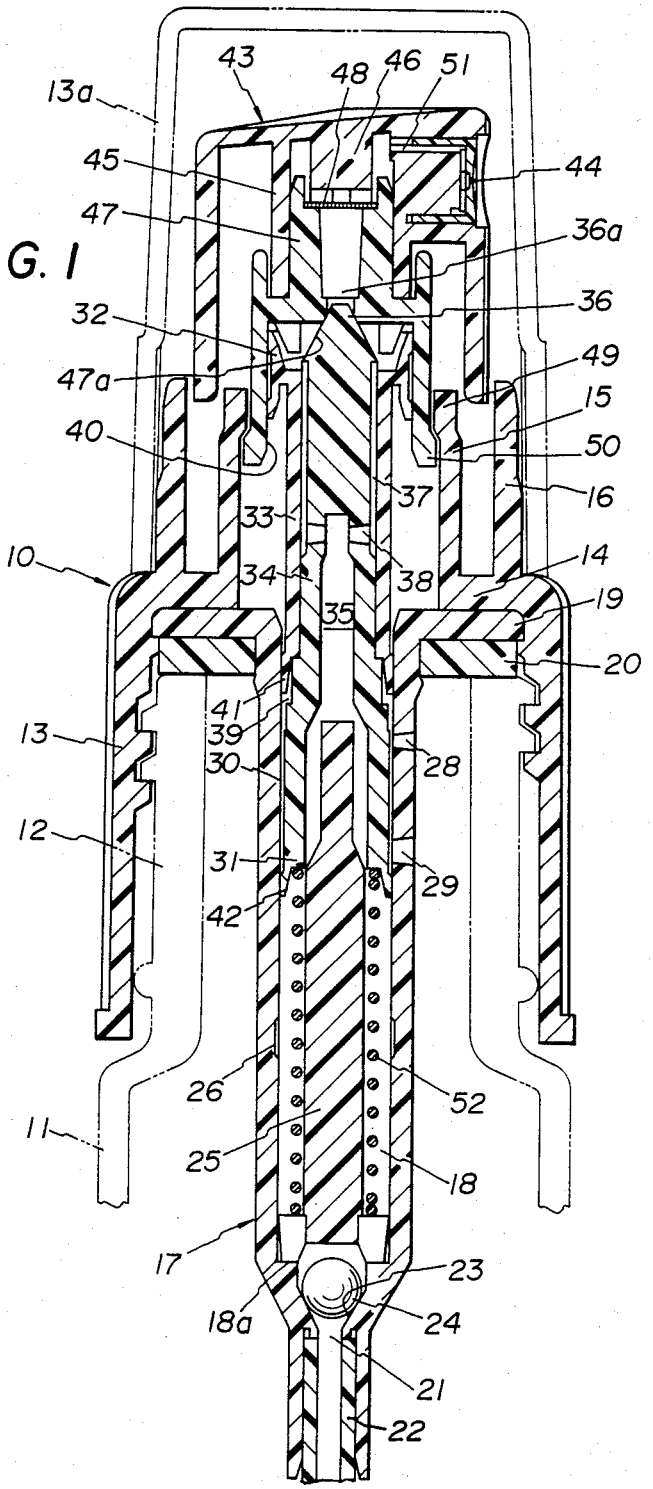
FIG. 1 is a longitudinal sectional view of an upper portion of a miniature atomizer showing one preferred embodiment exemplifying the present invention in the state before the atomizer head is depressed.
Figure 2:
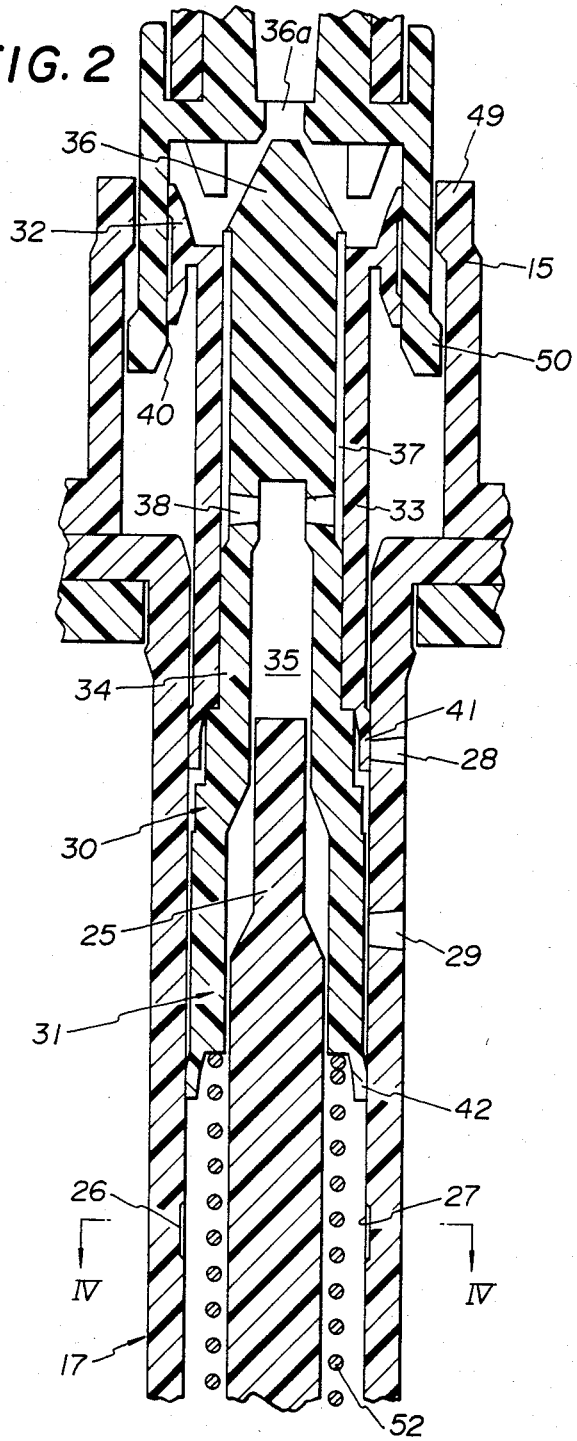
FIG. 2 is an expanded longitudinal sectional view of the tubular pistons telescopically sliding in the cylinders of the miniature atomizer shown in FIG. 1 in the condition during the depressing operation of the actuator.

A manual type miniature atomizer constructed according to one preferred embodiment of the present invention will now be described with reference to the drawings, particularly to FIG. 1 showing the upper portion of the miniature atomizer and to FIG. 2 showing the pressure chamber in the condition during the depressing operation of the actuator, respectively constructed according to the present invention, wherein like reference numerals designate the same parts in the following views. The miniature atomizer, as generally indicated at reference numeral 10, comprises a liquid container 11 which is formed with a neck portion 12. The atomizer 10 further comprises a cap 13 which has an internally threaded portion 13 formed on the lower portion of the inner face thereof and screwed on the externally threaded portion of the neck portion 12. The cap 13 is formed integrally with a radially inwardly extending flange 14 at substantially the middle thereof.

Inner and outer engaging tubular portions 15 and 16 are integrally extended upwardly from the innermost and the outer ends, respectively, of the flange 14. The inner tubular portion 15 has an upper annular inward land formed at the uppermost inside face thereof, which land is engaged with a lower annular outward land formed at the lowermost outside face of an upper cylinder 40 as will be hereinafter described in greater detail. An overcap 13*a* is detachably coated over the outer engaging tubular portion 16. A shell means 17 is formed and arranged to depend downwardly from the center of the cap 13 into the liquid container 11 through the bore of the neck portion 12. The shell means 17 is also formed internally with a first cylinder 18 as the essential component of a pressure chamber and is further formed at its upper end thereof with a radially outwardly extending flange 19 integrally projected therefrom, which flange 19 in turn is retained through a gasket 20 between the upper end of the mouth of the container 11 and the flange 14 of the cap 13. The first cylinder 18 is formed at its lower portion with a restricted bore which acts as a valve opening 21. In the lower portion of the cylinder 18, there is fitted a suction tube 22 at one end thereof in a manner to communicate with the valve opening 21 and at the other opposite end thereof in a manner to depend downwardly from the cylinder 18 to such an extent that its lower extremity reaches the bottom wall of the liquid container 11.

The inside wall of the cylinder 18 is partially countertapered immediately above the valve opening 21 between a step portion 18*a* formed thereon and the valve opening 21 to provide a valve seat 23, on which a ball type valve member 24, made of metal such as stainless steel, is seated in operation as a first one-way valve. Thus, the liquid in the liquid container 11 can have operational communication with the inside of the cylinder 18 by way of the suction tube 22. The step portion 18*a* of the cylinder 18 acts as a stop or seat for a stem 25 slidably disposed vertically within the cylinder 18. On the inside peripheral wall of the cylinder 18 is formed a relatively shallow annular recess 26 as a gap forming portion slightly above the step portion 18*a*. One or more elevational ribs 27 are formed axially of the cylinder 18 within the recess 26 (FIG. 4) in height of the same plane as the inner wall of the first cylinder 18. Above the recess 26 there are provided in the cylinder 18 a vent hole 28 for preventing vacuum from occurring in the cylinder 18 and a vent-hole 29 for pumping or priming in the cylinder 18, both of which holes 28 and 29 are vertically spaced from each other.

Generally indicated at reference numeral 30 is a sliding tubular member, which has its lower portion inserted into the bore of the cylinder 18. This tubular member 30 is formed at least with a first lower tubular piston 31 at its lower end and with a second upper tubular piston 32 at its upper end. The first piston 31 consists of outer and inner cylindrical members 33 and 34. Within the inner cylindrical member 34 is perforated a hollow portion 35 so as not to interfere or obstruct the stem 25 slidably disposed within the cylinder 18. A conical valve body 36, which may be of needle type is formed at the upper solid portion of the inner cylindrical member 34 above the hollow portion 35 to be slidably disposed within the outer cylindrical member 33 at the upper bore portion. On the outer face of the upper solid portion of the inner cylindrical member 34 are formed a plurality of axial passage grooves 37, through which holes 38 are radially perforated toward the hollow portion 35. Thus, fluid communication is provided from the hollow portion 35 through the holes 38 and the passage grooves 37 with the upper chamber of the second piston 32. The outer cylindrical member 33 is elevationally shorter in length than the inner cylindrical member 34 to extend at the lower end thereof to the vicinity of a step portion 39 formed on the outer peripheral face of the inner cylindrical member 34 in engagement therewith. Both the outer and inner cylindrical members 33 and 34 of the first piston 31 are formed respectively at the lowermost edges thereof with sealing skirts 41 and 42, which are made to elastically contact hermetically with the inside wall of the cylinder 18.

The second upper tubular piston 32 is slidably disposed within a larger cylinder 40 which has a larger diameter than that of the first cylinder 18. Thus it will be appreciated that there is now provided a further second pressure chamber in axial alignment with the first pressure chamber above the cap 13. This larger cylinder 40 is made to depend from an atomizer head or actuator 43, which in turn is formed with a nozzle outlet 44 opened at the upper side face thereof and is also formed with a tubular 45 depending from the internal center thereof and with a cylindrical projection 46 depending downwardly from the inside center of the tubular cylinder 45.

The larger cylinder 40 is formed at the uppermost end thereof with a reduced-diameter tubular cylinder 47, which in turn is inserted into the tubular cylinder 45 of the actuator 43. Onto the upper end face of the tubular cylinder 47 is attached a mesh filter 48 made of synthetic resin mesh such as nylon mesh, or metal mesh such as stainless steel mesh which allows passage of liquid fed from the liquid container but does not pass fine solid contents and insolubles contained in the liquid therethrough, thus prohibiting passage of the solid contents and insolubles into a liquid passage 51 to the nozzle outlet 44.

The larger cylinder 40 is loosely elevationally slidably inserted into the engaging tubular portion 15 as was previously described in such a manner that the upper annular inward land 49 of the engaging tubular portion 15 is engaged with the lower annular outward land 50 of the upper cylinder 40 to thereby prevent the cylinder 40 from being disengaged from the engaging tubular portion 15. Opposite to the conical valve body 36 of the inner cylindrical member 34 is formed a valve seat 47*a* at the center of the inside upper wall of the cylinder 40 in space with a valve opening 36*a* to provide fluid communication from the liquid container 11 through the suction tube 22, the valve opening 21, the cylinder 18, the hollow portion 35 of the inner cylindrical member 34, the holes perforated at the cylindrical member 34, the passage grooves 37, and the valve opening 36*a* with the passage 51 to the nozzle outlet 44.

A coil spring 52 is interposed between the step portion 18*a* of the first cylinder 18 and the lower end of the first lower tubular piston 31 of the sliding tubular member 30. This coil spring 52 is mounted around the stem 25 within the inner wall of the first cylinder 18 to always urge upwardly the sliding tubular member 30 and the actuator 43.

With these construction arrangements, when the atomizer head actuator 43 is manually depressed in the condition that the liquid is filled within the pressure chambers, the first and second pistons 31 and 32 are integrally telescoped in the cylinder 18 together with the actuator 43. Since the valve member 24 and the valve body 36 of the inner cylindrical member 34 are kept closed in this state, the interiors of the cylinder 18, the hollow portion 35 of the inner cylindrical member 34 and the upper larger cylinder 40 (which form a pressure chamber) are abruptly pressurized by the manual depression of the actuator 43. Inasmuch as the liquid pressure receiving area of the second piston 32 in the elevational direction is larger than that of the first piston 31, the sliding tubular member 30 is moved downwardly as the liquid pressure applied onto the second piston 31 proceeds to become larger than the rebounding strength of the coil spring 52 to thereby cause the valve body 36 of the inner cylindrical member 34 to be moved downwardly to thus open the valve opening 36*a* as shown in FIG. 2. This introduces the pressurized liquid from the larger cylinder 40 through the valve opening 36*a* into the liquid passage 51, thus effecting the desired atomization of the fluid through the nozzle outlet 44. When the fluid pressure in the pressure chamber is reduced due to the atomization of the fluid through the nozzle outlet 44 to thereby become lower than the rebounding strength of the coil spring 52, the sliding tubular member 30 is raised by means of the rebounding strength of the coil spring 52. At this stage, the valve body 36 of the inner cylindrical member 34 shuts off the valve opening 36*a* on its returning stroke to thereby stop the atomizing operation.

That is, since the valve opening 36*a* is opened only while the fluid pressure in the pressure chamber is boosted to a predetermined level and is automatically closed by the valve body 36 of the inner cylindrical member 34 when the liquid pressure applied onto the second piston 31 becomes lower than the rebounding strength of the coil spring 52, no liquid droplet is intermittently injected from the nozzle outlet 44 nor is dropped therefrom, but the atomizer can completely atomize the liquid in the container. The fluid pressure in the pressure chamber is reduced on this returing stroke of the sliding tubular member 30 to thereby open the ball type valve member 24, so that the liquid confined in the container 11 is sucked thereinto by way of the suction tube 22 to thereby charge the liquid thus sucked into the cylinder 18. When the actuator 43 is again depressed to repeat the aforementioned operation, the liquid can be atomized from the nozzle outlet 44 as desired.

According to the essential features of the present invention, the assembly of the elements is so remarkably simplified as to accomplish the assembly of the atomizer promptly. More specifically the ball type valve member 24, the stem 25 and the coil spring 52 are sequentially inserted into the first cylinder 18, the sliding tubular member 30 is subsequently inserted into the cylinder 18, the larger cylinder 40 is then inserted over the tubular member 30 into the cylinder 18, the cap 13 is further coated on the flange 19 of the shell 17, and the actuator 43 assembled in advance with the nozzle 44 is then mounted thereon to thus complete the assembly of the atomizer 10. Since the atomizer 10 is thus assembled, the stem 25 can perform the functions of the guide of the coil spring 52 and of the occupying member in the hollow space as the actuator 43 is depressed. As a result, this stem 25 can be expected to act as the volume reducing member which reduces the volume of the bore of the sliding tubular member 30 under that depressed condition to thereby provide a highly efficient atomizer of miniature size, which can be assembled simply and conveniently.

When the miniature atomizer is, on the other hand, to be used for the first time, it is impossible to introduce the liquid in the liquid container 11 into the pressure chamber until the air, which has occupied that pressure chamber, is discharged. In the case, more particularly, where the atomizer has such a construction that its valve body 36 of the inner cylindrical member 34 remaines closed until the pressure prevailing in the pressure chamber reaches a predetermined level, the air therein is still left under a compressed condition even after the depressing operation of the atomizer head or actuator 43 is finished. As a result, the evacuation of the pressure chamber remains insufficient even after the atomizer head or actuator 43 is returned to its raised position. Accordingly, the amount of introduction of the liquid in the liquid container 11 into the pressure chamber would be insufficient. Accordingly, a clearance or gap forming portion e.g., a recess or projection for releasing the sealing effect of the piston portion is formed on the lower inner face of the lower small-diameter cylinder, and an air vent hole is perforated to release the residual pressure through the gap between the sliding tubular member 30 and the inner wall surface of the cylinder 18 into the liquid container 11 when the sliding tubular member 30 is depressed down to its lower limit in the conventional known atomizer. However, the sliding tubular member 30 is draped at the sealing skirts 41 and 42 thereof with the recess to thereby cause the remaining pressure not to be relieved through the vent hole to thus permit no pumping or priming operation of the liquid sometimes.

An important feature of the present invention for solving the above problem will now be described in conjunction with the one or more elevational ribs 27 axially formed within the recess 26 in height of the same plane as the inner wall of the first cylinder 18 according to the present invention.

Figure 3:
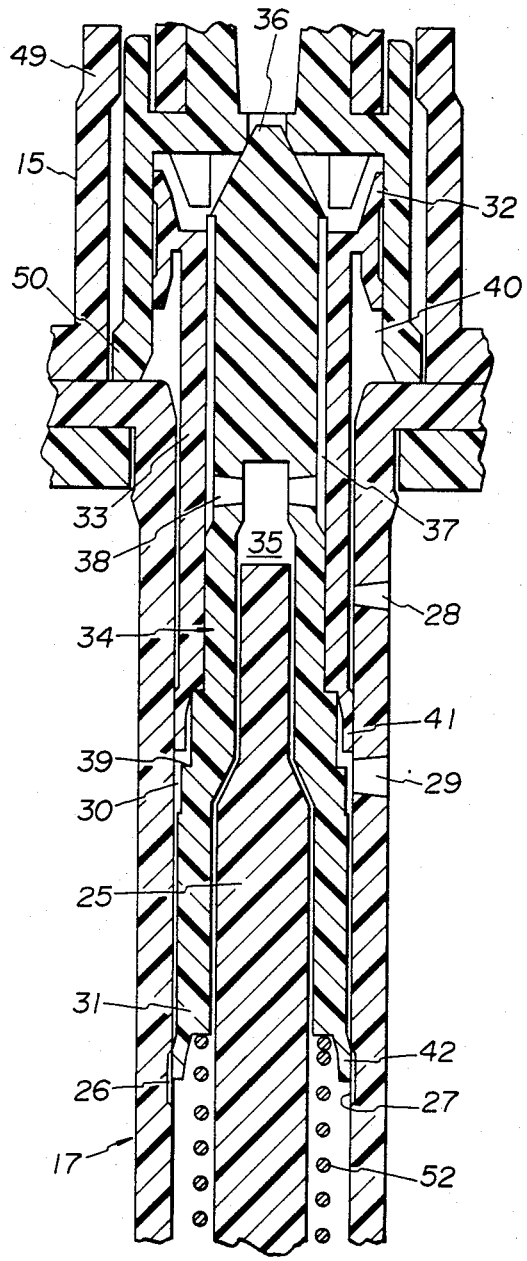
FIG. 3 is a view similar to FIG. 2 but showing the condition that the actuator is depressed to its lower end.
Figure 4:
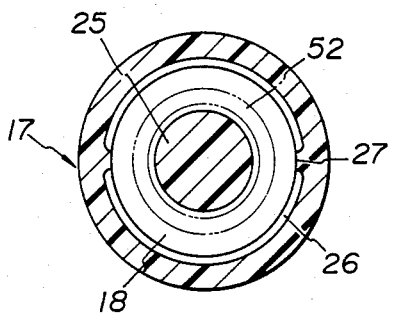
FIG. 4 is an expanded cross sectional view of the atomizer taken along the line IV—IV in FIG. 2.

FIGS. 2 and 3 show an enlarged scale of the sliding tubular member and the tubular pistons telescopically inserted into the cylinders for clarifying the aforementioned features of the atomizer according to the present invention, wherein other portions are omitted for simplicity of discussion only, and FIG. 4 shows the enlarged scale in cross section of the recess of the first cylinder.

When the sliding tubular member 30 is raised to its uppermost position as better seen in FIG. 1, the aforementioned two vent holes 28 and 29 are positioned to face the lower half portion of the inner cylindrical member 34, and the skirts 41 and 42 serve to provide their sealing effects above the vent holes 28 and below the lower vent hole 29, respectively. Under this condition, as the sliding tubular member 30 is depressed downwardly upon depressing of the actuator 43, the upper skirt 41 goes below the vent hole 28 as designated in FIG. 3. When the sliding tubular member 30 is further depressed down to reach its lowermost positon as designated in FIG. 3, the lower skirt 42 goes into the annular recess 26. However, the sealing skirt 42 has, at this particular moment, its sealing function stopped due to the existence of the elevational ribs 27 to thereby retain partial clearance or a gap at the lower skirt 42. Accordingly, when the sliding tubular member 30 is moved downwardly to its lowermost position, the first piston 31 of the sliding tubular 30 cannot have hermetical sealing contact with the inside wall of the cylinder 18 by the action of the elevational ribs 27. As a result, the desired relief passage is established to provide fluid communication between the lower skirt 42 and the annular recess 26 and between the outer surface of the inner cylindrical member 34 and the facing inside wall of the cylinder 18 and from the liquid container 11 through the vent hole 29 with the cylinder 18. At this instant, however, it should be noted that the sealing effect is still obtained in a position between the vent holes 28 and 29 by the action of the upper sealing skirt 41 on the inside wall of the cylinder 18, thus preventing the compressed air in the pressure chamber from leaking to the outside of the miniature atomizer 10 around the mouth portion of the cylinder 18 together with the liquid.

The space provided between the vent holes 28 and 29 is suitably determined by the length and stroke of the first tubular piston 31. The vent hole 28 for preventing vacuum from occurring in the cylinder 18 acts to prevent excessive vacuum from taking place in the liquid container 11 even after the liquid in the container 11 is gradually reduced through its atomizing process. The vent hole 29 for pumping or priming the liquid in the cylinder 18 is so positioned as to be closed by the first tubular piston 31 or its skirts 41 and 42 when the sliding tubular member 30 returns to its uppermost position and as to be opened, when the piston 31 is moved downwardly, thereby to permit therethrough introduction of the ambient air into the liquid container 11.

The miniature atomizer 10 according to the present invention further comprises, as has been described previously, the mesh filter 48 provided between the valve body 36 of the inner cylindrical member 34 and the liquid passage 51 introduced to the nozzle outlet 44 onto the upper end face of the tubular cylinder 47. In case that fine solids and insolubles are contained in the pressurized liquid, they are forcibly introduced through the passage 51 into the nozzle outlet 44 to thereby block the nozzle outlet 44 therewith, thereby allowing no atomization of the liquid from the nozzle outlet 44. The mesh filter 48 thus provided, accordingly, acts to obstruct or prohibit passage of the solids and insolubles contained in the liquid to thereby maintain fluid communication through the passage 51. The preferable mesh filter is made of plastic material such as nylon, saran or metallic material such as stainless steel, which is not corroded by the liquid contained in the atomizer, and has approx. 200 meshes. This mesh filter 48 is preferably adhered or bonded onto the upper end face of the tubular cylinder 47 over the larger cylinder 40 by means of an ultrasonic welding process.

Figure 5:
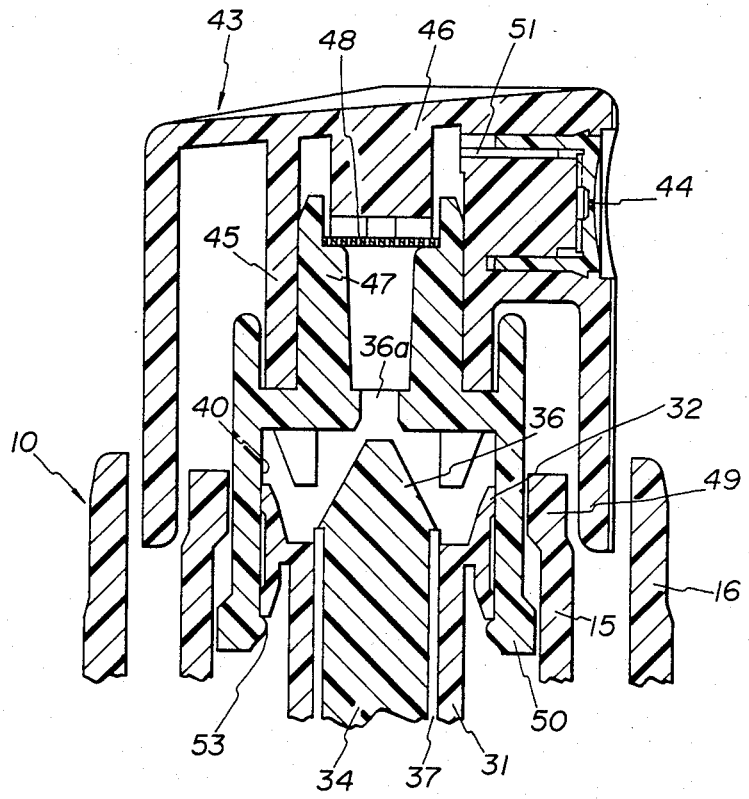
FIG. 5 is an expanded longitudinal sectional view of the upper portion of the miniature atomizer showing a construction that an annular radially inward land for preventing the piston from discharging out of the cylinder is formed on the inner wall of the cylinder as exemplified according to another embodiment of the present invention.

Turning now to FIG. 5, a second embodiment of the present invention will be described and in which like reference numerals will indicate the same parts that correspond to the views of the previous embodiment shown in FIGS. 1 through 4. In this embodiment, however, an annular inside projection 53 is formed on the lower inside peripheral wall of the larger cylinder 40 to thereby prevent the second upper tubular piston 32 from disengaging from the larger cylinder 40. The projection 53 is formed so high as to be less than the inner diameter of the cylinder 40. Accordingly, the tubular piston 32 can be readily assembled with the atomizer by forcibly inserting the tubular piston 32 into the larger cylinder 40, thereby preventing, when once inserted, the piston 32 from being disengaged from the cylinder 40 in the ordinal reciprocating movements of the piston 32 within the cylinder 40.

It should be understood from the foregoing description that since the manual type miniature atomizer according to the present invention can feed not only the air but also the liquid in the pressure chamber to the inside of the liquid container through the relief passage formed when the sliding tubular member comes to its lowermost position particularly in its first use though it has such a construction that the air is forcibly compressed midway of the liquid passage leading from the inside of the container to the nozzle outlet, the desired liquid suction into the pressure chamber can be accomplished reliably and promptly upon elevation of the tubular member even in the first use of the atomizer.

It should also be appreciated that since the sliding tubular member of the atomizer of the present invention incorporates the first piston and the second piston having a larger liquid pressure receiving area than the first piston and the valve body 36 of the inner cylindrical member 34 opens, when the actuator is depressed down to cause the liquid pressure applied onto the second piston 31 becomes larger than the rebounding strength of the coil spring 52, the valve opening **36*a* to thereby atomize the liquid and automatically shuts off, when the actuator is released up to cause the liquid pressure applied onto the second piston 31 becomes lower than the rebounding strength of the coil spring 52, the valve opening 36*a***, no liquid droplet is injected nor dropped from the nozzle outlet but the atomizer can completely atomize the liquid in the container.

It should also be understood that since the atomizer according to the present invention incorporates one or more elevational ribs 27 axially formed within the recess 26 of the first cylinder 18 and the ribs 27 thus formed provide, when the sliding tubular member 30 is moved downwardly to its lowermost position, clearance or gap and accordingly liquid communication between the lower skirt 42 and the annular recess 26 of the first cylinder 18, they provide smooth pumping or priming operation of the liquid, it can completely atomize the liquid.

What is claimed is:

1. A liquid spraying device, comprising:

a container having a neck;

an axially perforated cap engaged with the neck of said container;

an actuator having a fluid passage, elevationally movably associated with the upper portion of said cap;

nozzle means formed on a face of said actuator;

first pressure chamber means having a spring seat, extending downwards from the interior of said cap, having an upper vent hole for preventing vacuum formation in said first pressure chamber means, a lower vent hole for priming said first chamber, a recess formed on the inside peripheral wall of said first pressure chamber means and an elevational, axially-extending rib formed in said recess and having a height so as to extend to the level of the inner wall of said first pressure chamber means, said rib defining a straight, uninterrupted, continuous surface across said recess with the inside peripheral wall of said first pressure chamber means;

second pressure chamber means formed in axial alignment with said first pressure chamber means, within said actuator, having a larger diameter than said first pressure chamber means;

a sliding tubular member telescopically inserted into said first pressure chamber means, having a first piston member formed at the lower portion of said tubular member and a second piston member having an upper chamber formed at the upper portion of said tubular member and telescopically inserted into said second pressure chamber means, said first piston member having upper and lower sealing skirts formed to elastically and hermetically contact the inside wall of said first pressure chamber means, said rib providing a gap between the lower sealing skirt and the first pressure chamber means to introduce air within said first pressure chamber means into said container when said sliding tubular member is moved to its lowermost position, said first piston member comprising outer and inner cylindrical members, a stem being slidably disposed in said first pressure chamber means, said inner cylindrical member comprising a hollow lower portion for inhibiting movement of the stem slidably disposed within said first pressure chamber means, an upper solid portion with a conical valve body slidably disposed within the outer cylindrical member, said upper solid portion comprising a plurality of axial passage grooves on the outer face of the upper solid portion and holes radially extending from said grooves providing fluid communication from the lower hollow portion to the upper chamber of said second piston, said upper and lower sealing skirts being formed at the lowermost edges of said inner and outer cylindrical members;

spring means located between the spring seat of said first pressure chamber means and the lower end of said first piston member for upwardly urging said sliding tubular member and said actuator;

an openable valve member disposed at the bottom of said first pressure chamber means;

a tubular cylinder extending downwards from the interior of said actuator, having a cylindrical projection extending downwards from the interior of said tubular cylinder; and a reduced-diameter cylinder formed at the upper end of said second pressure chamber means and inserted into the tubular cylinder of said actuator.

2. A liquid spraying device, comprising:

a container having a neck;

an axially perforated cap engaged with the neck of said container;

an actuator having a fluid passage, elevationally movably associated with the upper portion of said cap;

nozzle means formed on a face of said actuator;

first pressure chamber means having a spring seat, extending downwards from the interior of said cap, having an upper vent hole for preventing vacuum formation in said first pressure chamber means, a lower vent hole for priming said first chamber, a recess formed on the inside peripheral wall of said first pressure chamber means and an elevational, axially-extending rib formed in said recess and having a height so as to extend to the level of the inner wall of said first pressure chamber means, said rib defining a straight, uninterrupted, continuous surface across said recess with the inside peripheral wall of said first pressure chamber means;

second pressure chamber means formed in axial alignment with said first pressure chamber means, within said actuator, having a larger diameter than said first pressure chamber means;

a sliding tubular member telescopically inserted into said first pressure chamber means, having a first piston member formed at the lower portion of said tubular member and a second piston member having an upper chamber formed at the upper portion of said tubular member and telescopically inserted into said second pressure chamber means, said first piston member having upper and lower sealing skirts formed to elastically and hermetically contact the inside wall of said first pressure chamber means, said rib providing a gap between the lower sealing skirt and the first pressure chamber means to introduce air within said first pressure chamber means into said container when said sliding tubular member is moved to its lowermost position, said first piston member comprising outer and inner cylindrical members, a stem being slidably disposed in said first pressure chamber means, said inner cylindrical member comprising a hollow lower portion for inhibiting movement of the stem slidably disposed within said first pressure chamber means, an upper solid portion with a conical valve body slidably disposed within the outer cylindrical member, said upper solid postion comprising a plurality of axial passage grooves on the outer face of the upper solid portion and holes radially extending from said grooves providing fluid communication from the lower hollow portion to the upper chamber of said second piston, said upper and lower sealing skirts being formed at the lowermost edges of said inner and outer cylindrical members;

spring means located between the spring seat of said first pressure chamber means and the lower end of said first piston member for upwardly urging said sliding tubular member and said actuator;

an openable valve member disposed at the bottom of said first pressure chamber means;

a tubular cylinder extending downwards from the interior of said actuator, having a cylindrical projection extending downwards from the interior of said tubular cylinder;

a reduced-diameter cylinder formed at the upper end of said second pressure chamber means and inserted into the tubular cylinder of said actuator; and a mesh filter interposed in the fluid passage of said actuator, attached to the upper surface of the reduced-diameter cylinder.

* * * * *